US011505978B2

(12) United States Patent
Miglioranzo

(10) Patent No.: US 11,505,978 B2
(45) Date of Patent: Nov. 22, 2022

(54) HINGE FOR THE CONTROLLED ROTARY MOVEMENT OF A DOOR, A DOOR LEAF OR SIMILAR

(71) Applicant: OL.MI S.R.L., Castelnuovo del Garda (IT)

(72) Inventor: Ivano Miglioranzo, Valeggio sul Mincio (IT)

( * ) Notice: Subject to any disclaimer, the term of this patent is extended or adjusted under 35 U.S.C. 154(b) by 0 days.

(21) Appl. No.: 17/284,460

(22) PCT Filed: Jul. 23, 2019

(86) PCT No.: PCT/IB2019/056276
§ 371 (c)(1),
(2) Date: Apr. 10, 2021

(87) PCT Pub. No.: WO2020/079496
PCT Pub. Date: Apr. 23, 2020

(65) Prior Publication Data

US 2021/0355730 A1 Nov. 18, 2021

(30) Foreign Application Priority Data

Oct. 15, 2018 (IT) ..... 102018000009455
Oct. 15, 2018 (IT) ..... 102018000009456
Oct. 15, 2018 (IT) ..... 102018000009457

(51) Int. Cl.
*E05F 3/22* (2006.01)
*E05F 3/10* (2006.01)
*E05F 3/12* (2006.01)
*E05D 7/10* (2006.01)

(52) U.S. Cl.
CPC ..... *E05F 3/104* (2013.01); *E05F 3/12* (2013.01); *E05F 3/22* (2013.01); *E05D 7/105* (2013.01);
(Continued)

(58) Field of Classification Search
CPC ..... E05F 3/104; E05F 3/10; E05F 3/20; E05F 3/22; E05F 3/225; E05F 3/227;
(Continued)

(56) References Cited

U.S. PATENT DOCUMENTS 3,838,477 A * 10/1974 Evans ..... E05F 3/104 16/55
5,291,630 A * 3/1994 Brown ..... E05F 3/104 16/56

(Continued)

FOREIGN PATENT DOCUMENTS

KR 20100033133 3/2010
WO 2006066661 6/2006
WO 2007135341 11/2007

*Primary Examiner* — Chuck Y Mah
(74) *Attorney, Agent, or Firm* — Themis Law

(57) ABSTRACT

A hinge for the controlled rotatable movement of a closing element anchored to a stationary support structure includes a pivot, a hinge body and a hydraulic damping cylinder. The pivot has a first axis and includes a cam, and the hinge body is engaged to the pivot so as to be rotatably coupled to each other around the first axis. The hydraulic damping cylinder includes a jacket and a plunger element, and the jacket defines a second axis, houses a working fluid and is divided into a first and a second variable volume compartment in fluid communication with each other. The plunger has a first and a second end respectively inserted into the first and second variable volume compartment to slide sealingly in the jacket. The hinge body includes a working chamber defining a third axis that is substantially perpendicular to the first axis and contains an elastic counteracting member.

14 Claims, 7 Drawing Sheets

(52) U.S. Cl.
CPC ... *E05Y 2201/456* (2013.01); *E05Y 2201/638* (2013.01); *E05Y 2201/706* (2013.01)

(58) Field of Classification Search
CPC ..... E05Y 2201/456; E05Y 2201/706; E05Y 2201/638; E05Y 2800/268; E05Y 2900/132; E05Y 2600/452; E05Y 2600/41; E05D 7/086; E05D 7/10; E05D 7/105; Y10T 16/552; Y10T 16/5525; Y10T 16/56; Y10T 16/593; Y10T 16/2769; Y10T 16/2771; Y10T 16/2774; Y10T 16/283; Y10T 16/304
See application file for complete search history.

(56) References Cited

U.S. PATENT DOCUMENTS

| | | | | |
|---|---|---|---|---|
| 7,003,847 | B2 * | 2/2006 | Brown | E05F 3/104 16/56 |
| 2005/0177975 | A1 * | 8/2005 | Wang | E05F 3/225 16/60 |
| 2008/0092446 | A1 * | 4/2008 | Bienek | E05F 3/10 49/334 |
| 2010/0024159 | A1 * | 2/2010 | Oh | E05F 3/104 16/54 |
| 2014/0053369 | A1 * | 2/2014 | Miglioranzo | E05F 3/104 16/54 |
| 2016/0168897 | A1 * | 6/2016 | Miglioranzo | E05D 11/1064 16/50 |
| 2018/0010376 | A1 * | 1/2018 | Beattie | E05D 11/1014 |
| 2019/0203515 | A1 * | 7/2019 | Benedetti | E05D 3/02 |
| 2020/0115943 | A1 * | 4/2020 | Bacchetti | E05F 1/1253 |

* cited by examiner

HINGE FOR THE CONTROLLED ROTARY MOVEMENT OF A DOOR, A DOOR LEAF OR SIMILAR

FIELD OF THE INVENTION

The present invention generally regards the technical field of hinges, and it particularly regards a hinge for the controlled rotatable movement of a door, a shutter or the like.

STATE OF THE ART

Hinges comprising a hinge body and a pivot mutually couplable to each other to allow a closing element, for example a door, a shutter or the like, to rotate between an open position and a closed position, are known.

Such hinges further include a working chamber inside the hinge body sliding in which is a plunger element, and damping means acting on the plunger to slow the movement to close and/or closing it.

For example, a similar hinge is described in the international patent application number WO2015159256.

Though excellently meeting the pre-set tasks, such hinges can be improved in terms of ease of assembly and, more generally, the costs and duration over time.

SUMMARY OF THE INVENTION

An object of the present invention is to at least partly overcome the aforementioned drawbacks, by providing a hinge that is highly functional and inexpensive.

Another object of the present invention is to provide a hinge that is easy to manufacture and/or assemble.

Another object of the present invention is to provide a hinge wherein the parts at mutual contact reveal minimal wear.

Another object of the invention is to provide a hinge that is highly durable over time.

Another object of the present invention is to provide a hinge that is compact and has small overall dimensions.

Another object is to provide a hinge that has a minimum number of components.

Another object of the present invention is to provide a hinge with adjustment of the opening and/or closing speed of the closing element.

These and other objects that will be more apparent hereinafter, are attained by a hinge according to what is described, illustrated and/or illustrated herein.

Advantageous embodiments of the invention are defined according to the dependent claims.

BRIEF DESCRIPTION OF THE DRAWINGS

Further characteristics and advantages of the invention will be more apparent in light of the detailed description of some preferred but non-exclusive embodiments of a hinge 1, illustrated by way of non-limiting example with reference to the attached drawings, wherein.

DETAILED DESCRIPTION OF SOME PREFERRED EMBODIMENTS

With reference to the aforementioned figures, herein described is a hinge 1 for the controlled rotatable movement of at least one closing element, such as a door, a shutter or the like, anchored to a stationary support structure, such as a wall, a floor, a frame or the like.

Depending on the configuration, the hinge 1 may be a closing and/or opening hinge, i.e. suitable to open and/or close the closing element from the open and/or closed position, or a control hinge, for opening and/or closing.

Figure 11A:
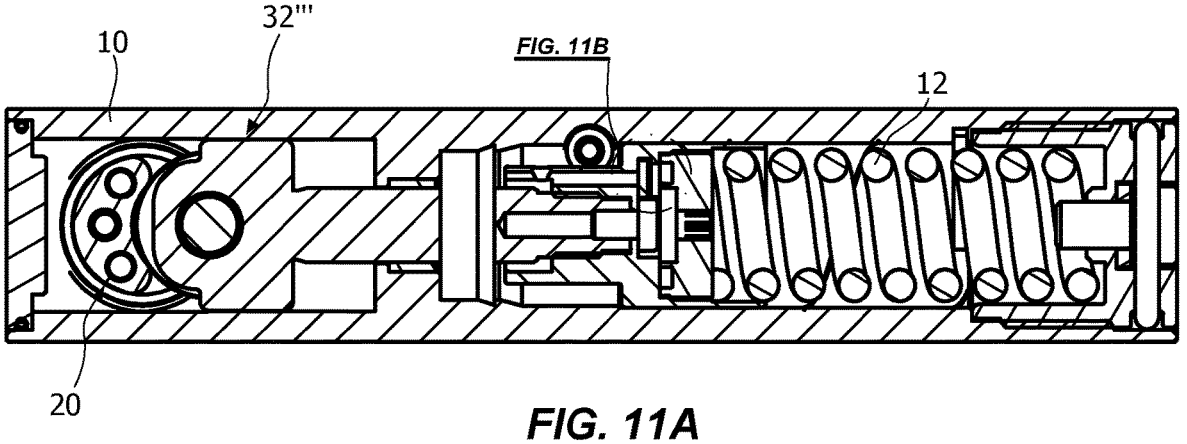
FIG. 11A is a radial sectional view of a further embodiment of a hinge 100 including the check valve 350.
Figure 11B:
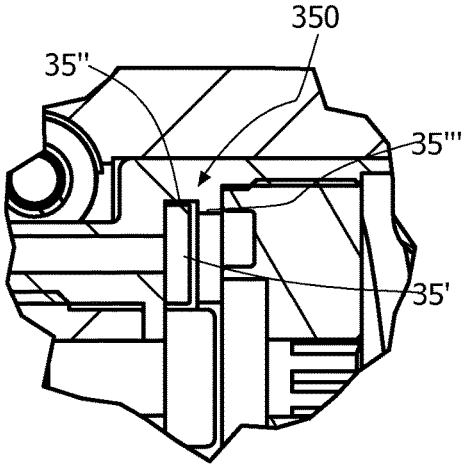
FIG. 11B is an enlargement of some details of FIG. 11A.
Figure 12A:
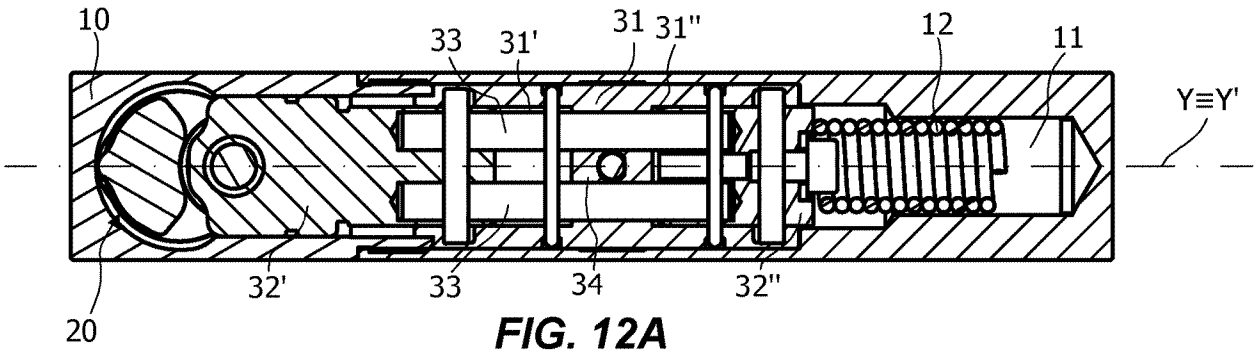
FIGS. 12A, 12B and 12C are axial sectional views of a further embodiment of the hinge 1.
Figure 13:
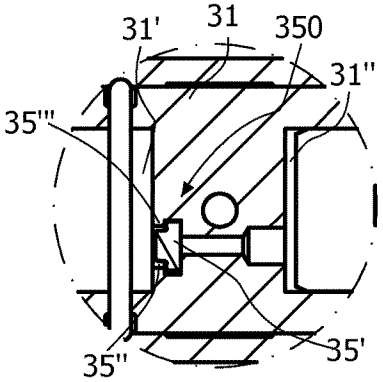
FIG. 13 is an enlarged axial sectional view of some details of the hinge 1 of FIGS. 12A, 12B and 12C.
Figure 12B:
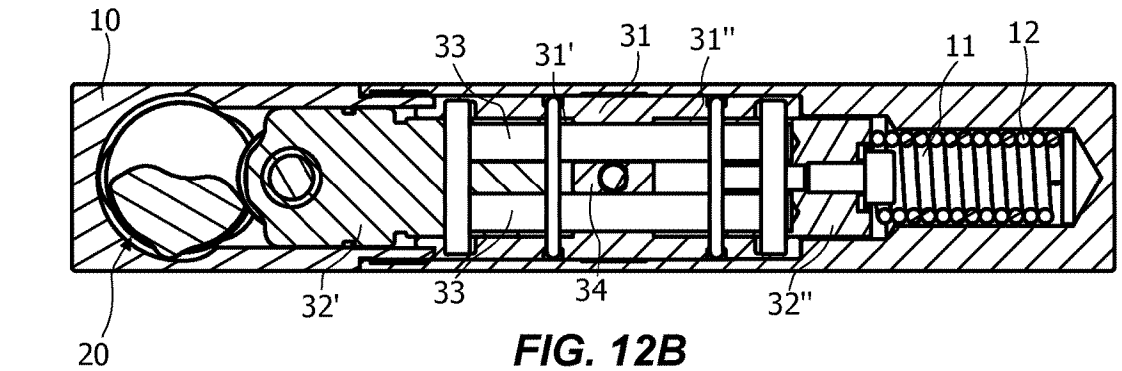
Figure 12C:
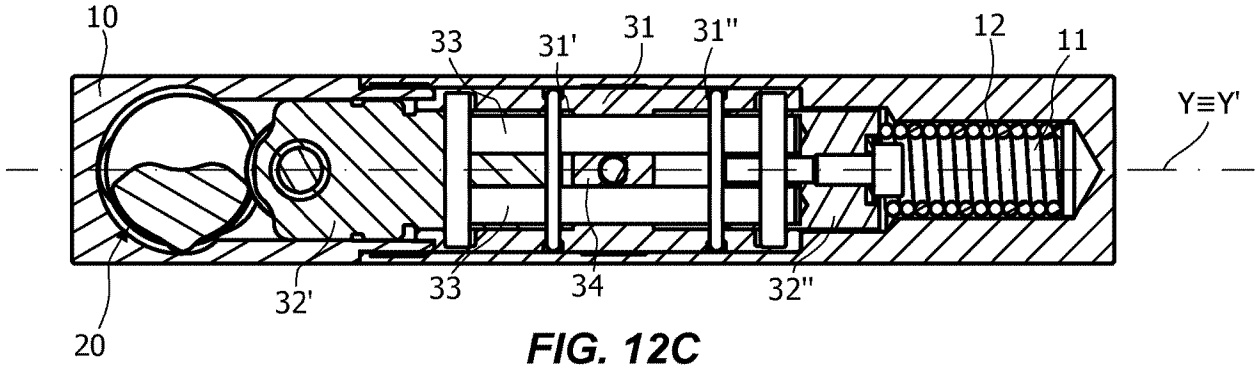

Suitably, the closing and/or opening hinge may include a closing or opening spring, for example as illustrated in FIGS. 1A-11B, while the control hinge may comprise a reset spring, for example as illustrated in FIGS. 12A-13.

Given that the closing element and the stationary support structure are per se known, they were not illustrated in the attached figures. As a matter of fact, such elements are not part of the invention claimed in the attached claims.

The hinge 1 may comprise a hinge body 10, preferably substantially box-shaped.

Figure 10:
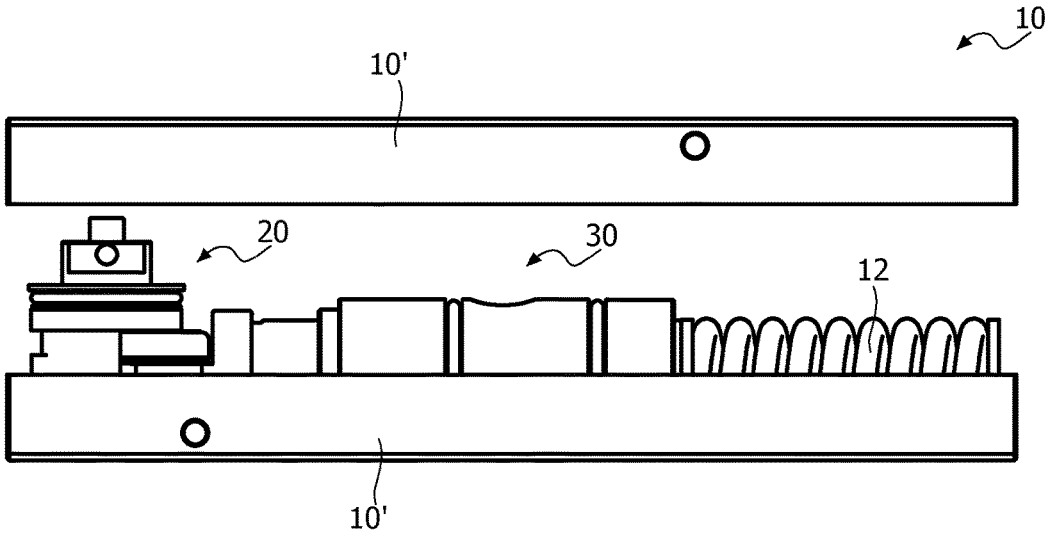
FIG. 10 is a schematic view of a further embodiment of the hinge 1.

Suitably, for example as illustrated in FIGS. 1 to 7 or in FIG. 10, the hinge body 10 may comprise or consist of a first portion or a first hinge half-body 10' and a second portion or a second hinge half-body 10".

The hinge half-bodies 10' and 10" may act as actual half-shells, thus internally enclosing all components of the hinge 1.

In the embodiment illustrated in FIGS. 1 to 7 the hinge half-bodies 10' and 10" may cooperate with each other to form the hinge body 10 acting along a radial direction, while in the embodiment illustrated in FIG. 10 the hinge half-bodies 10' and 10" may cooperate with each other to form the hinge body 10 acting along an axial direction.

In any case, the hinge body 10 may comprise a working chamber 11 defining an axis Y' and comprise elastic counteracting means 12, for example one or more reset or closing/opening springs.

One or more interface elements 13, for example a pair of metallic washers, may be provided for positioned at the ends of the elastic counteracting means 12 for minimising the wear of the of the surfaces at contact with the latter, and in particular with the bottom wall 11' of the hinge body 10.

Preferably, the hinge body 10 may comprise a pivot 20 defining an axis X.

In the embodiments illustrated in the attached figures, the box-shaped hinge body 10 will be anchorable to the stationary support structure, while the pivot 20 will be anchorable to the closing element, for example by means of the coupling portion 22'. Thus, the box-shaped hinge body 10 will be fixed, while the pivot 20 will be rotatable.

Advantageously, the axis X may thus also define the rotation axis of the closing element.

However, it is clear that the box-shaped hinge body 10 may be anchorable to the closing element, while the pivot 20 may be anchorable to the stationary support structure without departing from the scope of protection of the attached claims.

According to a preferred but non-exclusive embodiment, the pivot 20 may include cam means 21, which—in the embodiment illustrated herein—will be of the type rotating around the axis X. It is clear that in case of a stationary pivot 20 the cam means 21 will also remain stationary.

Suitably, the pivot 20 may be obtained as two portions 20' and 20", as disclosed by the international patent application number WO2015159256, to which reference shall be made.

In particular, the portion 20' may comprise the cam means 21, which may have two lateral concavities 21' and a central convex zone 21".

The portion 20" may comprise or consist of a base 20" couplable to the portion 20'.

Preferably, braking means 22, for example an IGUS® bushing, insertable in a suitable seat of the hinge body 10, as disclosed in the international patent application number WO2015159256, may be provided for.

Advantageously, the hinge 1 may comprise a hydraulic damping cylinder 30 removably couplable with the pivot 20 and the hinge body 10.

According to a preferred but non-exclusive embodiment, the half-body 10' may comprise a seat 14 inside which the hydraulic damping cylinder 30 may be inserted.

However, it is clear that a similar housing zone may be provided for in the half-body 10" or in both half-bodies without departing from the scope of protection of the attached claims.

Suitably, the hydraulic damping cylinder 30 may comprise a pair of end zones 30', 30".

The latter may be respectively interposed between an abutment wall 24 of the half-body 10" and an abutment wall 14' of the half-body 10'.

Thus, the abutment walls 14' and 24 may axially block the hydraulic damping cylinder 30.

Suitably, the half-bodies 10' and 10" may respectively comprise the coupling zones 15 and 25 to allow the mutual coupling thereof.

For example, such coupling zones 15 and 25 may respectively comprise a threading and a corresponding counterthreading.

Furthermore, it is clear that coupling zones may be provided for at the end zones 30' and 30" mutually couplable to the coupling zones 15 and 25 without departing from the scope of protection of the attached claims.

In a such configuration housing seats for the hydraulic damping cylinder 30 may not be provided for in the half-bodies 10' and 10", but it could be interposed between them. In other words, the hydraulic damping cylinder 30 may be inside the half-bodies 10' and 10", but the latter and the former may be coupled to each other to define the hinge body 10.

Advantageously, the hydraulic damping cylinder 30 may comprise the jacket 31 defining an axis Y which will coincide with the axis Y' when the cylinder 30 will be coupled with the half-bodies 10' and 10".

The jacket 31 may be divided into a first and second variable volume compartment 31', 31" placed in fluid communication with each other, inside which there will be included a working fluid, for example oil or compressed air.

Furthermore, the hydraulic damping cylinder 30 may comprise a plunger element 32 comprising a first and second end.

Preferably, such plunger ends 32 may consist of a first plunger 32' and a second plunger 32" sealingly slidable in the jacket 31.

The plungers 32' and 32" may be integrally joined by means of a pair of anti-rotation pins 33 for preventing the rotation with respect to the jacket 31 upon the sliding thereof along the axis Y.

The damping cylinder 30 may define the hydraulic damping means of the hinge 1. In particular, the entire working fluid of the hinge 1 may be entirely contained in the jacket 31, while the elastic counteracting means 12 and the pivot 20 may remain dry, i.e. they will not be submerged in an oil bath or wet by the latter.

This extremely simplifies assembling and hydraulic handling of the hinge, which actually remains entirely contained in the hydraulic damping cylinder 30. Besides the latter, all parts will remain dry.

More in particular, all the working fluid of the hinge may be contained between the inner surface of the jacket 31 and the facing surface of the first and the second plunger 32', 32", which will always lie in the jacket 31 without ever exiting therefrom. Thus, the first and second plunger 32', 32" may be sealingly inserted into the jacket 31.

Suitably, the plunger 32' may comprise cam follower means 32'" susceptible to interact with the cam means 21 for displacing the closing element between the at least one open position and at least one closed position.

In a preferred but non-exclusive embodiment, the cam follower means 32'" may be configured according to the disclosures of the international patent application no WO2015159256.

Thus, the cam follower means 32'" may suitably include a rotatable element 50 rotating around an axis X' substantially parallel to the axis X and spaced therefrom.

Advantageously, the rotatable element 50 may be cylindrical-shaped. For example, it may consist of a roller 50, which may in turn provide for a male element 51 and a female element 52 mutually superimposed and couplable. Thanks to such characteristic, the stresses deriving from the interaction with the cam means 21 will be equally distributed among the male 51 and female 52 elements, with considerable benefit to the durability of the hinge 1 over time.

The roller 50 may suitably be rotatably housed in an end seat 53 of the cam follower 32'" to rotate around the axis X'.

To this end, the roller 50 may have a central cylindrical portion 54 insertable into the seat 53 and two upper and lower disc-shaped portions 55', 55" with larger diameter with respect to the designed to come into contact with the cam means 21.

Advantageously, the roller 50 may rotate around the axis X' on bushings 56, so as to minimise frictions.

With the aim of guiding the sliding along the axis Y, Y' of the cam follower means 32'", the hinge body 10, and in particular the hinge half-body 10", may have a pair of opposite guide parts 17', 17" operatively engaged with a corresponding pair of opposite sliding surfaces 37', 37" of the plunger 32'. Such characteristic will allow long durability of the hinge 1 over time.

Figure 1A:
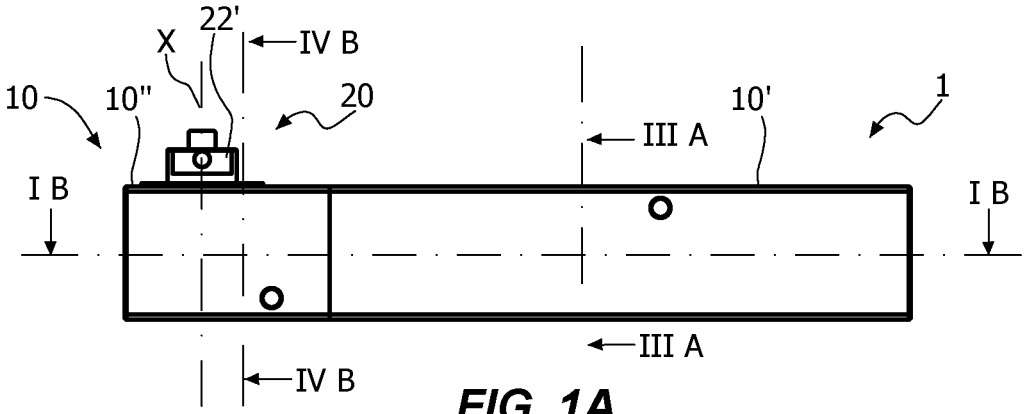
FIG. 1A is a lateral view of a preferred but non-exclusive embodiment of the hinge 1.
Figure 1B:
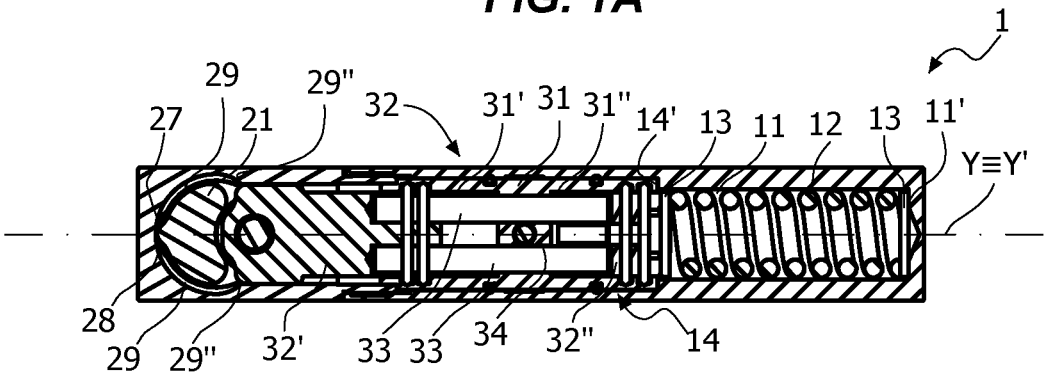
FIG. 1B is a sectional view taken along plane I B-I B of FIG. 1A.
Figure 2A:
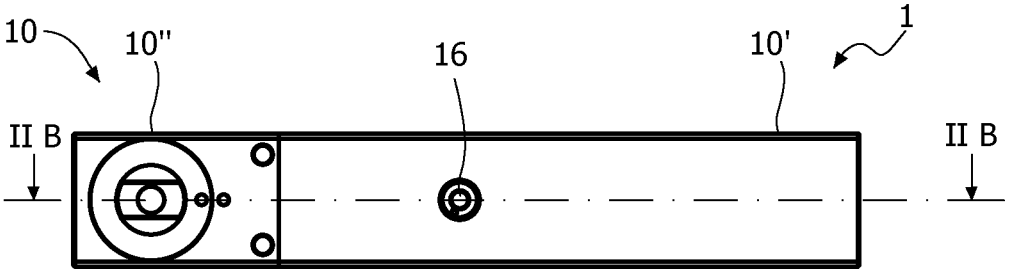
FIG. 2A is a top view of the hinge 1.
Figure 2B:
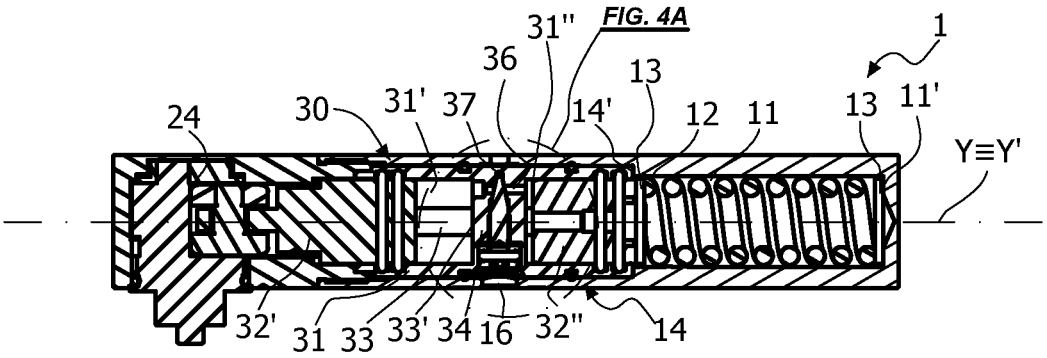
FIG. 2B is a sectional view taken along plane II B-II B of FIG. 2A.
Figure 3A:
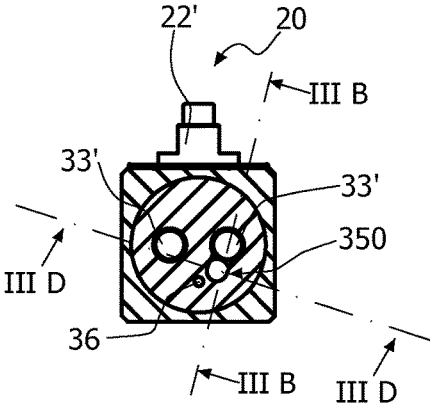
FIG. 3A is a sectional view taken along plane III A-III A of FIG. 1A.
Figure 3C:
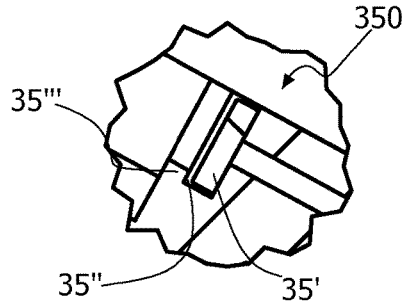
FIG. 3C is an enlargement of some details of FIG. 3B.
Figure 3E:
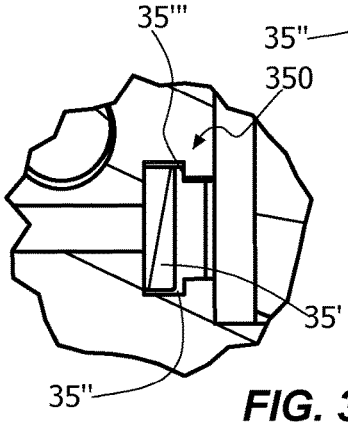
FIG. 3E is an enlargement of some details of FIG. 3D.
Figure 3B:
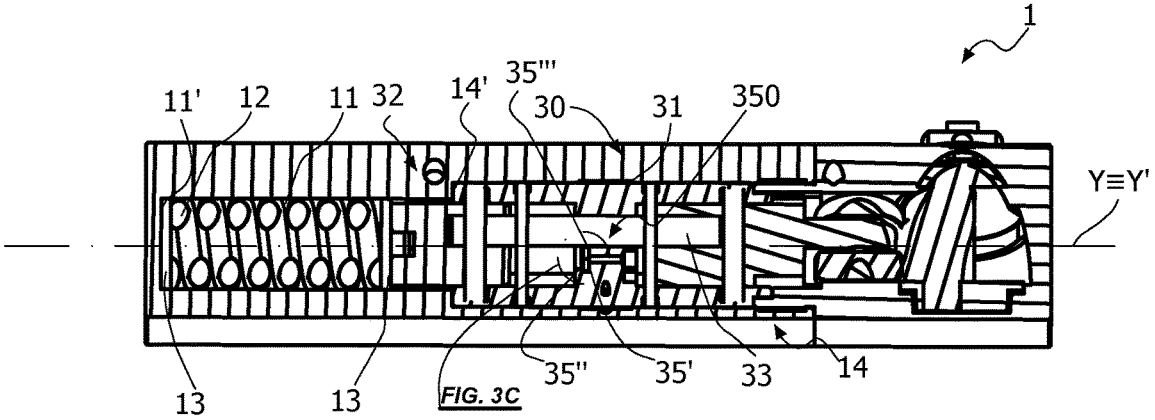
FIG. 3B is a sectional view taken along plane III B-III B of FIG. 3A.
Figure 3D:
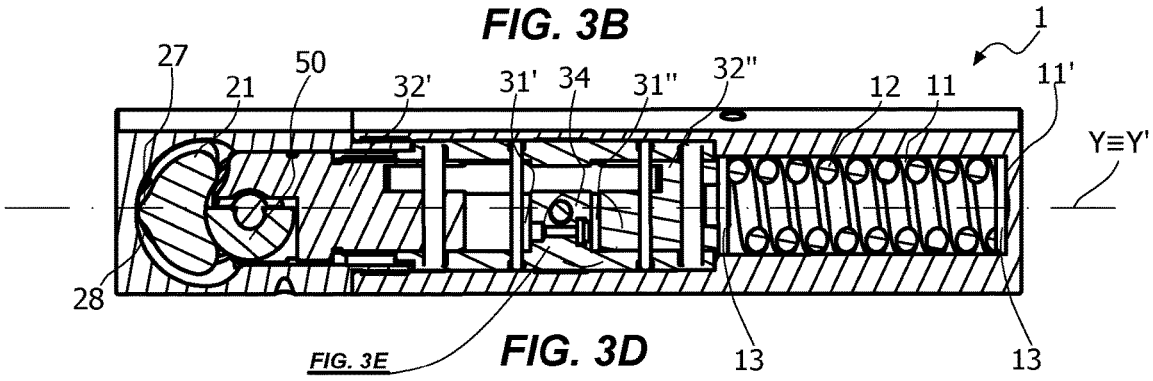
FIG. 3D is a sectional view taken along plane III D-III D of the hinge of FIG. 3A.
Figure 4A:
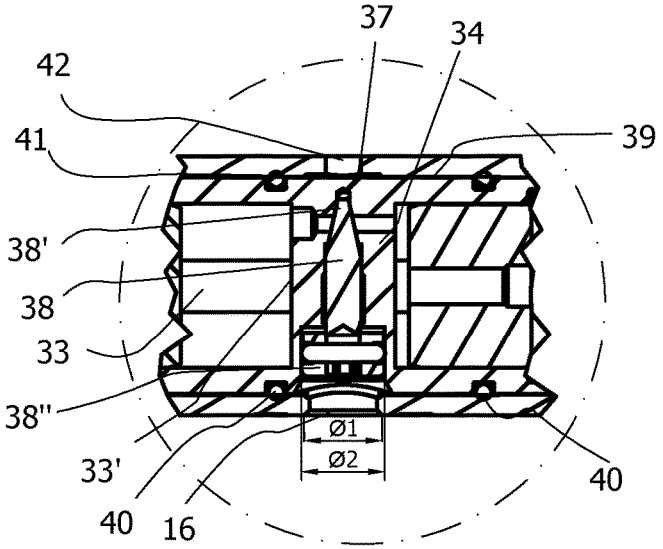
FIG. 4A is an enlargement of some details of FIG. 2B.
Figure 4B:
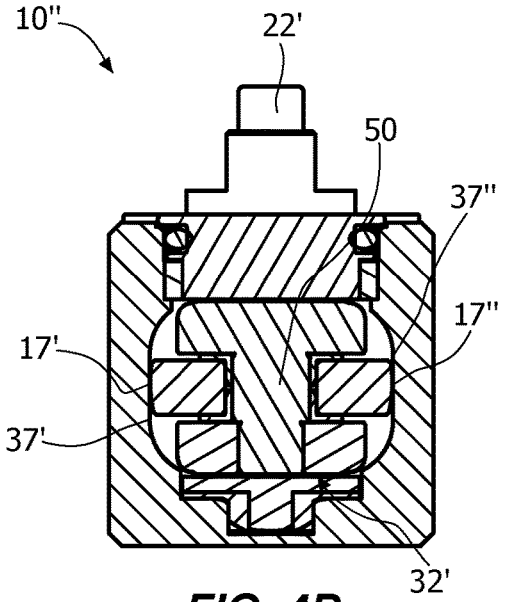
FIG. 4B is a sectional view taken along plane IV B-IV B of FIG. 4A.
Figure 5:
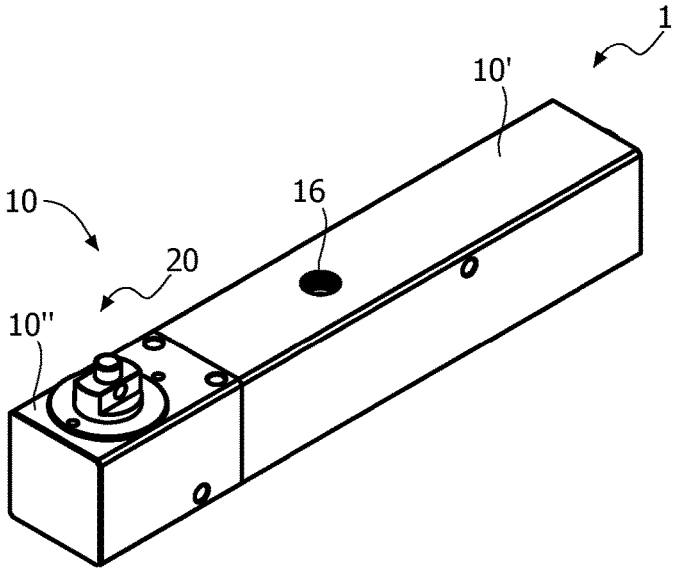
FIG. 5 is an axonometric view of the hinge 1 of FIG. 1A.
Figures 6, 7:
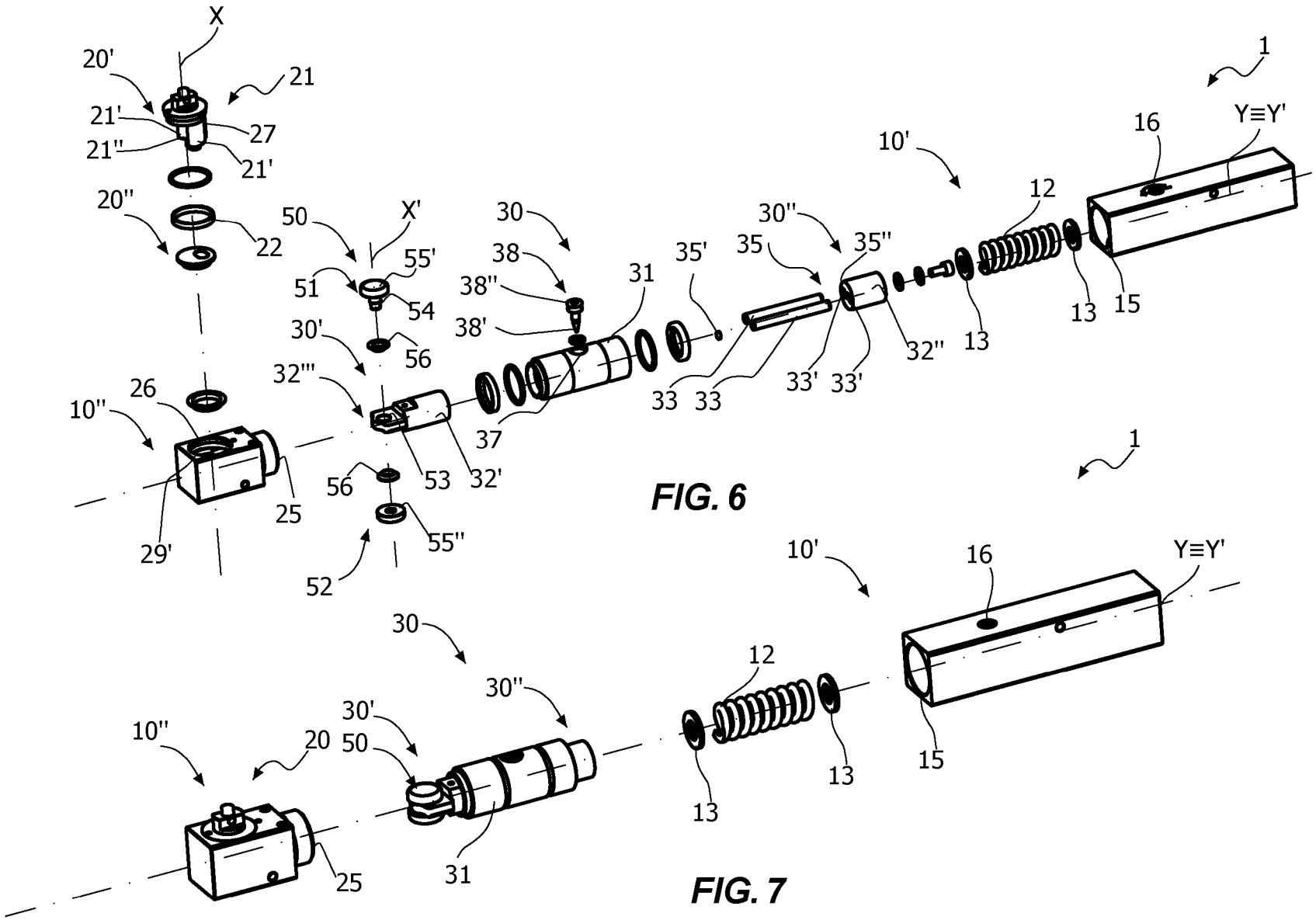
FIG. 6 is an exploded view of the hinge 1 of FIG. 1A.
FIG. 7 is a further exploded view of the hinge 1 of FIG. 1A.
Figure 8A:
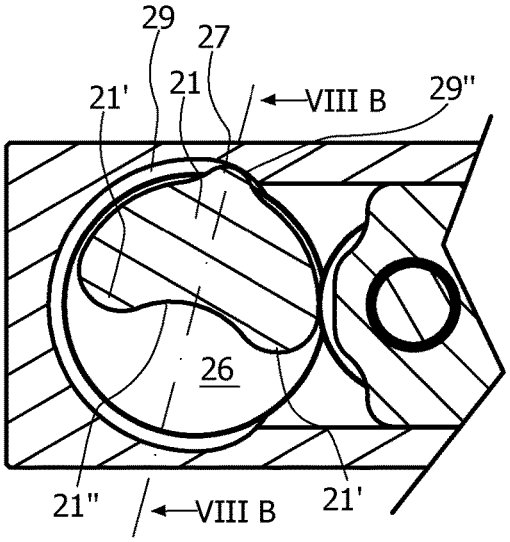
FIG. 8A is a sectional view taken along plane I B-I B of FIG. 1A of some details of the hinge 1, in which the pivot is positioned in abutment against the abutment surface 29"
Figure 8B:
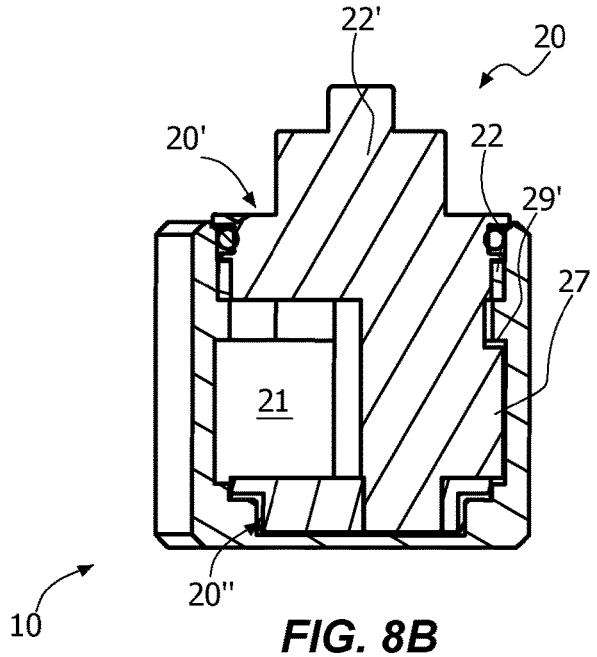
FIG. 8B is a sectional view taken along plane VIII B-VIII B of FIG. 8A.

Preferably, the plunger 32" may interact with the elastic counteracting means 12, the latter being susceptible to move the plunger 32" away from the bottom wall 11' of the working chamber 11 once the cam means 21 rotating around the axis X will have carried the plunger element 32, and in particular the integrally joined assembly between the plungers 32' and 32", from the closed door position, illustrated for example in FIG. 1B, to the door open position, illustrated for example in FIG. 8A.

The jacket 31 may suitably comprise a separation septum 34 defining the two variable volume compartments 31', 31".

Such separation septum 34 may be traversed by the pair of pins 33 through the through openings 33'.

Advantageously, the separation septum 34 may also comprise an opening 35 and an opening 36 for placing the two compartments 31', 31" in fluid communication.

It is clear that the opening 36 may be obtained on the body of the jacket 31 without departing from the scope of protection of the attached claims.

The opening 35 may comprise a check valve 350 susceptible to open upon the opening of the closing element.

However, it is clear that the check valve 350 may close upon the opening of the closing element and open upon the closing thereof without departing from the scope of protection of the attached claims. In such case, the movement of the closing element may be damped when opening.

The check valve 350 may suitably comprise a shutter 35' slidable parallel to the axis Y in a valve seat 35".

According to the example described and illustrated herein, upon the opening of the closing element, the working fluid may flow through the openings 35 and 36 from the first to the second variable volume compartment 31', 31".

Vice versa, upon the closing of the closing element, the shutter 35', subjected to the pressure of the working fluid flowing from the second to the first variable volume compartment 31", 31', will occlude the opening 35.

Thus, the working fluid may flow solely through the opening 36 thus damping the closing speed of the closing element.

Advantageously, the valve seat 35" may be substantially T-shaped and it may comprise an edge relief 35'" susceptible to act as an axial abutment for the shutter 35'.

Preferably, the valve seat 35" and the through opening 33' may be in a spatial relationship so that at least one of the pins 33 blocks the radial sliding of the shutter 35' to prevent the dislodging thereof from the valve seat 35".

More in particular, the valve seat 35" may be obtained immediately beneath the through opening 33', so that the valve seat 35" and the through opening 33' may define a substantially T-shaped element.

It is clear that the check valve 350 described above may be implemented on any hinge without departing from the scope of protection of the attached claims. In particular, such check valve 350 mounted on any hinge, and in particular on the plunger element thereof, may include the shutter 35' inserted into a substantially T-shaped valve seat 35" having an edge relief 35'" for blocking the radial sliding thereof and an upper abutment element for blocking the axial sliding thereof. For example, such characteristics may be implemented on a hinge obtained according to the disclosures of the international patent application no WO2015159256, for example as illustrated in FIGS. 11A and 11B.

Advantageously, the separation septum 34 may comprise a channel 37 intersecting the opening 36.

In the channel 37 there may be inserted an adjustment screw 38 for varying the through-flow section of the working fluid through the opening 36.

Thus, according to embodiment described herein, the closing speed of the closing element may be varied.

The adjustment screw 38 may suitably comprise an end 38' inserted into the opening 36 and an opposite end portion 38" accessible to a user or an operator to control the screw 38.

According to a preferred but non-exclusive embodiment, the half-body 10' may comprise a through hole 16 at the channel 37 to allow access to the screw 38.

It is clear that the threading and the counter-threading of the coupling zones 15 and 25 of the half-bodies 10', 10" will be suitably made to allow the alignment of the through hole 16 and of the channel 37 when the hinge body 10 and the hydraulic damping cylinder 30 will be mutually coupled.

Advantageously, the through hole 16 may have a diameter θ1 smaller than the diameter θ2 of the end portion 38" of the screw 38 to prevent the axial removal from the latter.

According to a preferred but non-exclusive embodiment, the interspace 39 between the jacket 31 and the half-body 10' may comprise a pair of sealing elements 40 arranged on opposite sides with respect to the through hole 16 to define—with the interspace 39—a drainage airtight chamber 41 for fluids possibly flowing into or flowing out through the hole 16.

Such chamber 41 may additionally comprise a further port 42 for the inflow and outflow of the drainage fluids.

Advantageously, the hinge body 10 and the jacket 31 may be made of aluminium, while the pivot portion 20', the pins 33, the elastic means 12, the interface elements 13 and the roller 50 may be made of steel. Furthermore, the pivot portion 20" and the plungers 32', 32" may suitably be made of brass.

Thus, elements with greater hardness will be interposed on other elements with lower hardness and, thus, more exposed to wear.

Furthermore, such choice of materials may allow a considerable saving with respect to obtaining the hinge 1.

The hinge body 10 may comprise a cylindrical seat 26 in which it may house the pivot 20.

Preferably, the latter may have a projection 27 at the portion 20' that can be selectively engaged with a recess 28 present in the seat 26 and extending along a direction parallel to the axis X, at the axis Y'.

The recess 28 will be designed to act as a guide for the axial insertion/removal of the pivot 20 thereinto/therefrom. More in particular, the recess 28 may be configures as an axial slot obtained in the hinge body 10.

However, it is clear that also the opposite may occur, i.e. the pivot 20 may comprise a recess and the cylindrical seat 26 may comprise a projection that can be selectively engaged with the latter, without departing from the scope of protection of the attached claims.

The cylindrical seat 26 may suitably allow the rotatable movement of the pivot 20 around the axis X and it may thus comprise a pair of recesses 29 suitable to allow such rotatable movement in the two directions of rotation opposite with respect to the recess 28.

Such recesses 29 may lie on a plane substantially perpendicular to the axis X. More in particular, such recesses 29 may be configured as curvilinear slots obtained in the hinge body 10.

Advantageously, the recesses 29 may each comprise an abutment surface 29' susceptible to impact the projection 27 of the pivot 20 to prevent the axial removal thereof. Such abutment surface 29' may suitably follow the curvilinear development of the recess 29.

On the other hand, the recesses 29 may each comprise an abutment surface 29" susceptible to impact the projection 27 of the pivot 20 to block the rotation thereof along the respective direction of rotation.

Basically, the abutment surface 29" may be arranged at the end of the recess 29 for acting as a mechanical abutment for the pivot. Naturally, the angular position of the abutment surface 29" will determine the locking position of the door.

Figure 9A:
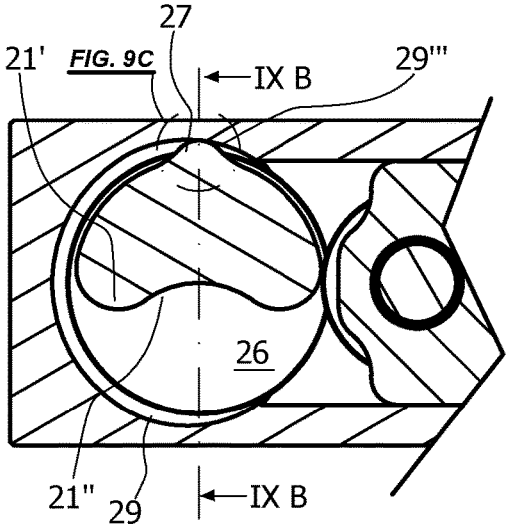
FIG. 9A is a sectional view of some details of an alternative embodiment of the hinge 1, wherein the pivot is at contact with the braking portion 29'"
Figure 9B:
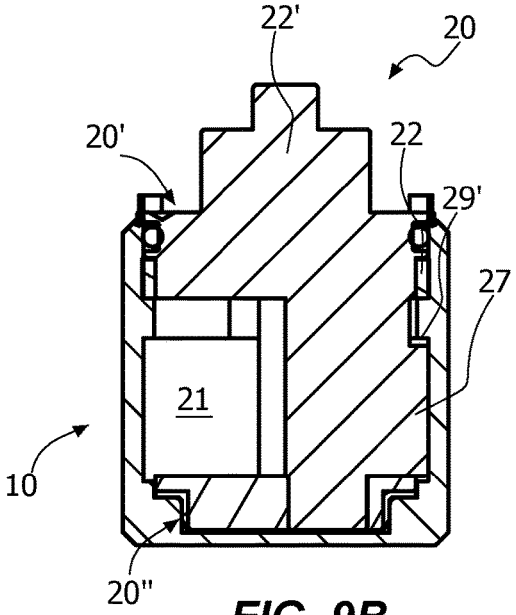
FIG. 9B is a sectional view taken along plane IX B-IX B of FIG. 9A.
Figure 9C:
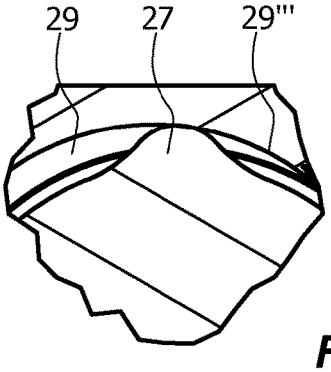
FIG. 9C is an enlargement of some details of FIG. 9A.

On the other hand, for example as illustrated in FIGS. 9A-9C, the recesses 29 may each comprise a final braking portion 29" configured to act progressively braking on the projection 27. In other words, such portion 29", which will be arranged at the end of the recess 29, may be configured so that—starting from the angular impact position of the projection 27 with it—the door is braked with progressive resistance.

In other words, starting from such angular position the user will feel a progressive resistance, natural variable depending on the configuration of the braking portion 29".

As clear, the recesses 28 and 29 will respectively define a guide for the insertion/removal of the pin 20 into/from the cylindrical seat 26 and means for preventing the removal from the latter during the rotation. Furthermore, the anti-removal means will also act as a mechanical abutment to limit the opening angle of the closing element and/or as a progressive mechanical braking.

Preferably, the projection of the pivot 27 and the recess 28 may be mutually configured so that when the pivot 20 is in the position for axial insertion/removal into/from the cylindrical seat 26, the cam means 21 are substantially perpendicular with respect to the axis Y. In other words, the insertion/removal of the pivot 20 will occur in the position corresponding to the closed door position, interposed between the maximum opening positions thereof.

It is clear that the guide for the insertion/removal of the pivot and the anti-removal means described above may be implemented on any hinge without departing from the scope of protection of the attached claims. For example, such characteristics may be implemented on a hinge obtained according to the disclosures of the international patent application no WO2015159256.

Furthermore, it is clear that the hinge may also include a single recess or projection 29, i.e. that the anti-removal means described above may extend in only one direction of rotation of the pivot 20.

FIGS. 12A-13 illustrate a control hinge 1, which may be configured as described above except for the fact that the elastic counteracting means 12 include a reset spring and that when the door is open the pin 20 is in the position illustrated in FIG. 12A and when the door is closed the pin 20 is in the position illustrated in FIG. 12B.

Thus, as illustrated in FIG. 13, the check valve 350 moves in the direction opposite to the one illustrated above, i.e. it opens upon the opening of the door sliding in the direction of the compartment 31' and it closes upon the closing of the door upon the closing of the door sliding in the direction of the compartment 31".

Furthermore, the pivot 20 is shaped so as to displace a larger amount of oil when the door is close to the closing position, for example as illustrated in FIG. 12B, so as to close it with damped effect (soft close).

Such embodiment is particularly indicated for closing inclined doors or shutters, in which the component of the weight force is almost null at the beginning of the movement and increases up to becoming maximum towards the door closed position.

In light of the above, it is clear that the hinge attains the pre-set objectives.

In particular, the hinge is much simpler to obtain and assemble, besides being particularly cost-effective. As a matter of fact, all the hydraulics are entirely contained in the damping cylinder 30.

The number of pieces is minimum, which—besides reducing the costs—makes the maintenance and replacement in case of malfunctioning easier.

As a matter of fact, should the hydraulic damping cylinder malfunction, it is possible to easily replace the damaged one with a new one in very little time. As a matter of fact, the two half-bodies 10' and 10" are basically two half-bodies which enclose the hydraulic damping cylinder 30.

Furthermore, the working fluid will remain inside the hinge body in case of exit from the hydraulic damping cylinder.

The presence of the airtight chamber mentioned above will prevent penetrations—into the hinge body—of possible fluids that flow thereinto, thus protecting the cam and cam follower means as well as the elastic means against oxidation.

Furthermore, in light of the characteristics outlined above, the parts at mutual contact will have minimum wear and, more generally, the hinge will have long durability over time.

Furthermore, the hinge will be extremely compact and have small overall dimension.

The hinge according to the invention is susceptible to numerous modifications and variants all falling within the inventive concept outlined in the attached claims. All details can be replaced by other technically equivalent elements, and the materials can be different depending on the technical needs, without departing from the scope of protection of the invention.

Even though the hinge has been described with reference to the attached figures, the reference numbers utilised in the description and in the claims are meant for improving the intelligibility of the invention and thus do not limit the claimed scope of protection in any manner whatsoever.

The invention claimed is:

1. A hinge for a controlled rotatable movement of a closing element anchored to a stationary support structure, comprising:

a pivot defining a first axis and anchorable to one of the closing element or the stationary supporting structure, the pivot comprising a cam;

a hinge body anchorable to another one of the closing element or the stationary supporting structure, the hinge body and the pivot being rotatably coupled so as to rotate one with respect to the other around the first axis;

a hydraulic damping system comprising:

a jacket defining a second axis; and a plunger comprising a first and a second end, wherein the hinge body comprises a working chamber defining a third axis that is perpendicular to the first axis and contains an elastic counteracting member, wherein the jacket is configured as a hydraulic damping cylinder and is divided into a first and a second variable volume compartment placed in fluid communication with each other, the first and second ends of the plunger being inserted respectively into the first and the second variable volume compartments to slide sealingly and jointly in the jacket, wherein the hinge comprises a working fluid entirely contained in the jacket, the elastic counteracting member and the pivot remaining dry, and wherein the hydraulic damping cylinder is removably couplable with the pivot and with the hinge body so that:

the second and third axis coincide or are parallel to each other, the elastic counteracting member interacts with one of the first or the second ends of the plunger, another one of the first and the second ends of the plunger being integrally coupled with a cam follower configured to mutually interact with the cam to displace the closing element between an open position and a closed position, wherein the plunger comprises a first plunger element, which includes or defines one of the first or the second ends, and a second plunger element, which includes or defines another one of the first or the second ends, the first and second plunger elements being integrally coupled to each other, the jacket comprising a separation septum, the first and the second plunger elements being inserted into the jacket from opposite sides with respect to the separation septum so as to define therewith the first and the second variable volume compartments.

2. The hinge according to claim 1, wherein the separation septum comprises a first opening for placing in fluid communication the first and the second variable volume compartments, which comprises a check valve, the jacket further comprising a second opening placing in fluid communication the first and the second variable volume compartment, the check valve being adapted to open upon an opening or closing of the closing element, and to close upon the closing or opening of the closing element so as to force the working fluid to exclusively flow through the second opening.

3. The hinge according to the claim 2, wherein the first and the second plunger elements are integrally coupled with at least one pin, the separation septum comprising at least one third through opening engaged by the at least one pin, the check valve comprising a shutter axially slidable in a valve seat to selectively engage the first opening, the at least one third opening and the valve seat being in a spatial relationship such that the at least one pin blocks a radial sliding of the shutter to prevent the shutter from getting out of the valve seat.

4. The hinge according to the claim 3, wherein the valve seat has a T-shaped section with an edge relief configured to act as an axial abutment for the shutter.

5. The hinge according to claim 3, wherein the at least one pin is provided as a pair of pins, and wherein the first and the second plunger elements are integrally coupled with the pair of pins to prevent a rotation with respect to the jacket when sliding along the second axis.

6. The hinge according to claim 2, wherein the separation septum further comprises a channel which intersects the second opening, an adjustment screw being inserted into the channel to vary a flow-through section of the working fluid through the second opening.

7. The hinge according to claim 6, wherein the hinge body has a pair of opposite guide parts operatively engaged with a corresponding pair of opposite sliding surfaces of the cam follower for guiding a sliding thereof along the second axis.

8. The hinge according to claim 6, wherein the hinge body comprises a first portion, which includes the elastic counteracting member, and a second portion, which includes the pivot, the first and the second portion being couplable to each other by interposing the hydraulic damping cylinder.

9. The hinge according to claim 8, wherein the hinge body is formed by a first hinge half-body defining the first portion and a second hinge half-body defining the second portion, the first and the second hinge half-bodies being couplable to each other, at least one of the first and the second hinge half-body comprising a seat for housing the hydraulic damping cylinder so that upon a coupling of the seat, the hydraulic damping cylinder is contained within the hinge body.

10. The hinge according to the claim 9, wherein the jacket comprises a first and a second end zone) opposite to each other, each of the first and the second hinge half-body including a first and respectively a second abutment wall configured to interact with the first and respectively the second end zone to axially lock the hydraulic damping cylinder in the hinge body.

11. The hinge according to claim 10, wherein the adjustment screw has a first end portion inserted into the second opening and a second opposite end portion, and wherein, after coupling of the first and the second hinge half-body, the channel lies in one of the first or the second hinge half-body, a through hole being provided by one of the first or the second hinge half-body to enable access by a user or operator to the second end portion of the adjustment screw for controlling the adjustment screw.

12. The hinge according to claim 11, wherein the through hole has a diameter smaller than a diameter of the second end portion of the adjustment screw so that the through hole prevents an axial removal of the second end portion of the adjustment screw.

13. The hinge according to claim 11, wherein an interspace between the jacket and one of the first or the second hinge half-body comprises a plurality of sealing elements arranged on opposite sides with respect to the through hole to define with the plurality of sealing elements a drainage airtight chamber for fluids that flow in or out through the through hole, the drainage chamber further comprising an additional port for an outflow or inflow of the fluids.

14. The hinge according to claim 1, wherein the elastic counteracting member is interposed between a bottom wall of the hinge body and one of the first or the second end of the plunger, the hinge body and the plunger being made of a material having a hardness lower than a hardness of the elastic counteracting member, an interface element being interposed between the elastic counteracting member and the bottom wall of the hinge body and/or between the elastic counteracting member and the first or the second end of the plunger to minimize wear of the plunger.

* * * * *